United States Patent [19]

Matsuda

[11] 4,167,194

[45] Sep. 11, 1979

[54] AUTOMATIC CUTOFF AND TESTER APPARATUS OF GAS SUPPLY

[76] Inventor: Tsuneki Matsuda, 1-8, Yuda 1-chome, Koufu-shi, Yamanash-ken, Japan

[21] Appl. No.: 846,842

[22] Filed: Oct. 31, 1977

[51] Int. Cl.[2] ..... F16K 17/36

[52] U.S. Cl. ..... 137/38; 137/462

[58] Field of Search ..... 137/38, 39, 462

[56] References Cited

U.S. PATENT DOCUMENTS

| | | | |
|---|---|---|---|
| 2,649,773 | 8/1953 | Griswold | 137/462 X |
| 2,812,770 | 11/1957 | Sullivan | 137/39 |
| 3,783,887 | 1/1974 | Shoji | 137/38 |

*Primary Examiner*—Robert G. Nilson

*Attorney, Agent, or Firm*—Holman & Stern

[57] ABSTRACT

Automatic cutoff and tester apparatus of gas supply is shown which utilizes a diaphragm powered valve, a disk which closes an intermediate opening of a gas pipe, and a gas distributor plenum which is formed by the disk and a diaphragm, and sensor means having several levers and metallic weight which is normally attracted to a permanent magnet means. The gas distributor plenum is passed to gas pipe through bypasses in which a reset valve and a sensor valve of swing are arranged. The sensor means operates automatically in accordance with swing. The diaphragm powered valve cuts off the gas pipe by operation of the diaphragm in accordance with operation of the sensor means, when earthquake occurred.

10 Claims, 6 Drawing Figures

AUTOMATIC CUTOFF AND TESTER APPARATUS OF GAS SUPPLY

BACKGROUND OF THE INVENTION

This invention relates to an automatic cutoff and tester apparatus of gas supply and more particularly to an automatic cutoff and tester apparatus of gas supply having diaphragm powered valve which is operated by sensor means in accordance with swing over a predetermined amplitude of earthquake, etc. The diaphragm powered valve is disposed within a chamber which has an opening on a gas pipe wall and is formed by extended cylindrical wall of the gas pipe.

The valve automatically closes an outlet of the opening in accordance with operation of the diaphragm which is operated by a press lever assembly arranged to a sensor means.

SUMMARY OF THE INVENTION

The present invention provides a new, safe and efficient means which is placed between a gas pipe and a terminal appliance in order to cutoff automatically the gas pipe and to prevent a gas flow when a swing over the predetermined amplitude occurs, and in order to check safely the closed or dangerous opened condition of the terminal appliances when gas is initially supplied after cutoff of the gas supply.

An object of the present invention is to provide an automatic cutoff and tester apparatus of gas supply which automatically closes an intermediate opening of the gas pipe in accordance with swing.

Another object of the present invention is to provide an automatic cutoff and tester apparatus of a gas supply which checks closed or opened conditions of terminal appliances when gas is initially supplied after cutoff of the gas supply.

Other object and many of the attendent advantages of this invention will be readily appreciated as the same becomes better understood by reference to the following description.

BRIEF DESCRIPTION OF THE DRAWINGS

The accompanying drawings illustrated the preferred embodiment of the present invention. In the drawings, the same reference numerals illustrated the same parts of the invention, in which.

THE DETAILED DESCRIPTION OF THE INVENTION

Figure 1:
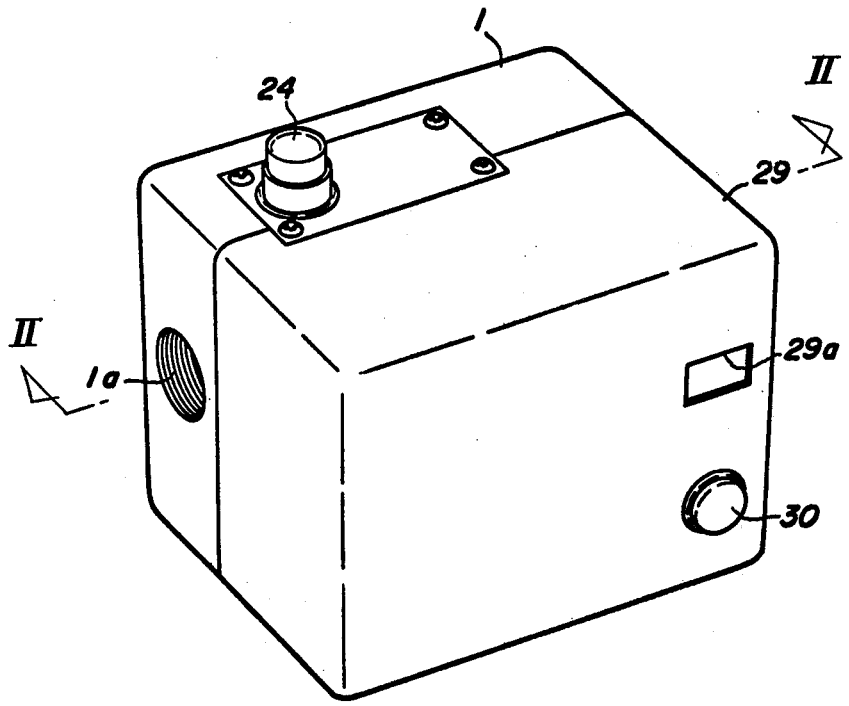
FIG. 1 is a perspective view of the main housing employed in one of the embodiments of the invention.
Figure 3:
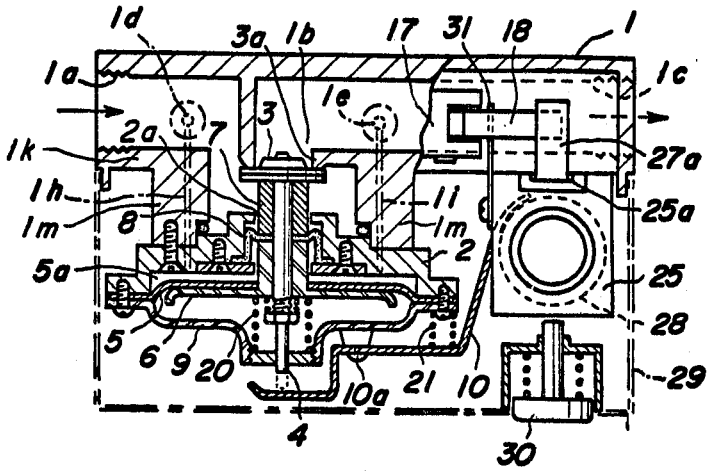
FIG. 3 is a cross-sectional front view of the apparatus of FIG. 1 taken along a line of III—III of FIG. 2.
Figure 2:
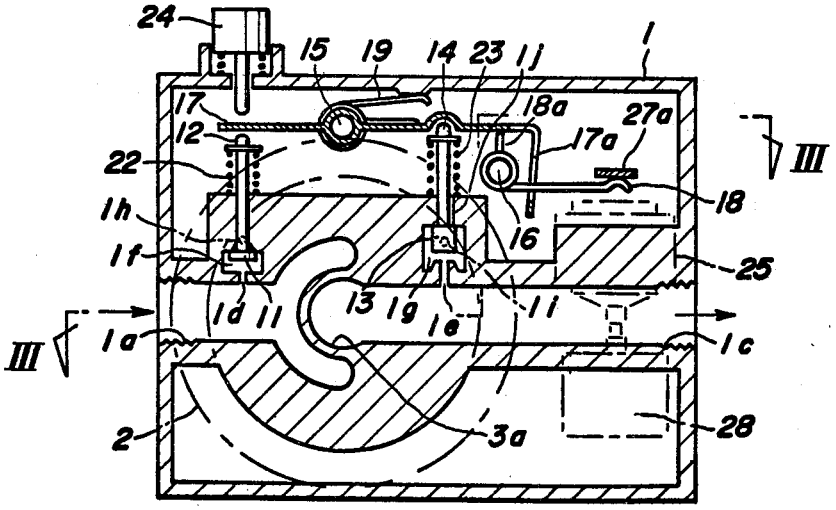
FIG. 2 is a cross-sectional plan view of the automatic cutoff and tester apparatus of FIG. 1 taken along a line of II—II of FIG. 1.

Referring to the drawings, there is shown according to one of the preferred embodiments of the present invention, as shown in FIGS. 2 and 3, an inlet passage 1a for gas supply side and an outlet passage 1c for terminal appliance side are respectively opened in a body 1, and the both passages 1a and 1c are joined at a portion of an opening 1b for valve engagement, also a bypass 1d of a fine hole and a reset chamber 1f are provided and joined in protrusion of the inner wall of the inlet passage 1a, and another bypass 1e of a similar fine hole and sensor valve chamber 1g are provided and joined in protrusion of the inner wall of the outlet pass 1c.

A valve body 3 having a pushrod 4 is arranged so as to close or open the opening 1b by operation from the side of said inlet pass 1a at a portion of valve seat 3a of the opening 1b which is joined to both passages 1a and 1c. The push rod 4 is covered by a supporting cylinder 7, and a disk 2 having plural steps and a center hole 2a is installed on protrusion 1m of the conduit 1k before the supporting cylinder 7 which is inserted in the center hole 2a. In this way, a resilient seal 8 is closely settled in the center of the disk 2 and seals compactly the space between the cylinder 7 and the disk 2.

In both side portions of disk 2, a bypass 1h which is connected to the reset valve chamber 1f is formed through the protrusion 1j of the conduit 1k, and another bypass 1i which is connected to the sensor valve chamber 1g is formed through said protrusion 1m, both bypasses 1h and 1i are respectively formed by fine hole. A diaphragm 5 which is attached to a supporting plate 6 is operatively installed on a flange of the disk 2 and is covered by a diaphragm cover 9. A gas distributor plenum chamber 5a is formed between the disk 2 and the diaphragm 5 and both bypasses 1h and 1i are opened to the plenum chamber 5a.

The foregoing supporting plate 6 is fixed to the valve pushrod 4 by a nut means, a spring 20 is provided on the pushrod 4 between the diaphragm cover 9 and the supporting plate 6. The valve body 3 is set on the valve seat 1b by elasticity of the spring 20.

As shown in FIG. 2, a reset valve 11 having a valve spindle 12 is provided in the reset valve chamber, in which the spindle 12 projects through a spindle hole and out of the conduit. Outer spring 22 is connected to the projected end portion of the spindle. By the spring 22, said reset valve shuts out normally the bypass 1h, and when the end of the spindle 12 is pushed, the valve opens the bypass 1h and the reset chamber and the plenum chamber 5a are connected through the bypass 1h. Also a sensor valve 13 having a valve spindle 14 is provided in the sensor valve chamber 1g, which the spindle 14 projects through a spindle hole which has a groove 1j extending out of the conduit. Outer spring 23 is engaged with the projected end portion of the spindle. By the spring 23, said sensor valve 13 shuts out normally the groove 1j and contrary opens the bypass opening 1e and the bypass 1i, and the sensor valve chamber 1g are connected to the plenum chamber 5a through the bypass 1i. Contrary, when the end of the spindle 14 is pushed, the sensor valve 13 is moved and shuts out the bypass opening 1e and cuts off the connection between the sensor valve chamber and the plenum chamber and the groove 1j is simultaneously opened.

Figure 6:
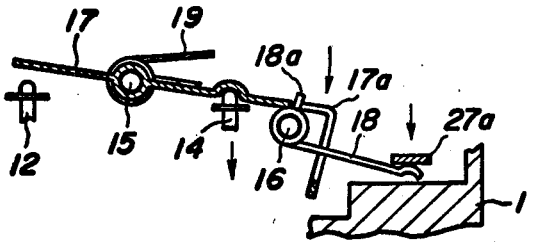
FIG. 6 is an operational diagrammatic view of the lever assembly on closed condition of the valve.

Between said spindle 12 and 14, a fulcrum axis 15 is horizontally provided with which a first lever 17 is rotatably engaged and pressed by a wire spring as shown in FIG. 2. An end of the lever 17 is bent and is formed to "L" shape and a slit 17a is properly formed along the center portion of the bent end. The lever 17 is properly curved at center portion between the fulcrum axis 15 and the bent portion thereof. The lever 17 is engaged with the fulcrum axis 15 to push generally the end of spindle 14 as shown in FIG. 6.

Figure 4:
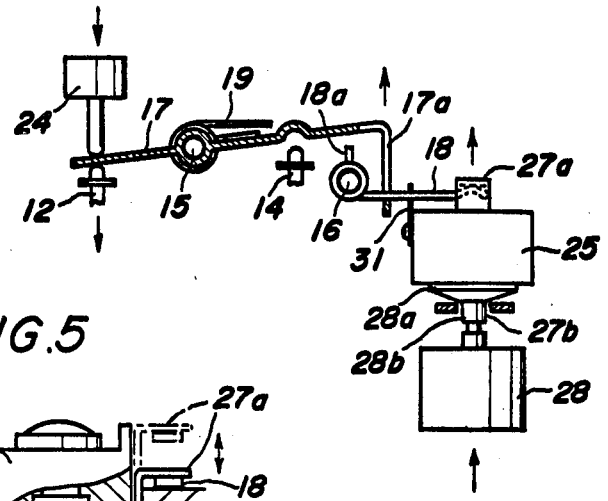
FIG. 4 is a semi diagrammatical vertical sectional view of lever assembly engaged with a sensor device comprising a metallic weight and a permanent magnet device on opened condition of the diaphragm power valve.
Figure 5:
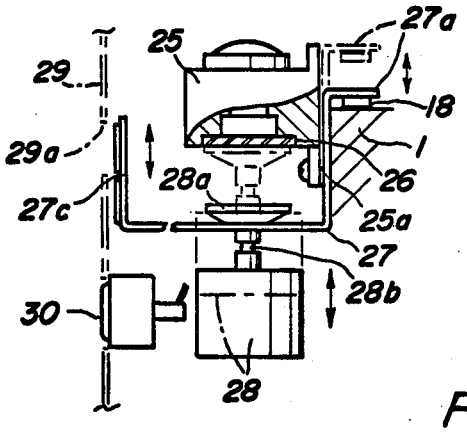
FIG. 5 is operational diagrammatic view of the sensor device and a test button.

Another fulcrum axis 16 is provided in parallel with the fulcrum axis 15. Second lever 18 is rotatably engaged with the fulcrum axis 16, and an end of the lever 18 is engaged in the slit 17*a* of the lever 17 and another end is extended at right angle. The extended end 18*a* is generally engaged on one side of the lever 17. Before resetting of the device, levers 17 and 18 are kept in condition of unengagement with a sensor means as shown in FIG. 6. Contrary when these levers 17 and 18 are reset, these are kept in condition of engagement with the sensor means as shown in FIG. 4.

A permanent magnet 26 is fixed under a supporting box 25 which has a vertical groove 25*a* on a back portion, which the box is installed at the point where the end of the lever 18 would be when the lever 18 is fallen. A flat spring 31 is attached on one side wall of the box 25 such that the lever 18 is resiliently pressed upward.

One side wall of a "U" shape swung plate 27 is slidably engaged in the groove 25*a* of the box 25. An end of the inserted side wall of the swung plate 27 is horizontally bent at right angle and the bent end is formed as a supporting part 27*a*, and a slit 27*b* is formed at the bottom of the "U" shape plate 27, also another end of the plate 27 has proper indication plate 27*c*.

A weight is comprised of a metallic plate 28*a* which is connected to a weight 28 by a fine axis 28*b* which is freely engaged in the slit 27*b* of the plate 27.

A control belt type lever 10 has plural steps and is arranged on the fulcrum 10*a*. One end of the lever 10 presses resiliently against side wall of the weight 28 by a spring 21 which is provided between an end of the diaphragm cover 9 and a center portion of the lever 10 and another end pushes the end of the valve pushrod 4 which projects from the diaphragm cover 9 as shown in FIG. 3. When the valve body 3 fixed on the pushrod 4 closes the opening 1*b*, the end of the pushrod 4 is withdrawn from the diaphragm 9 as shown in FIG. 3, and the spring 21 presses the lever 10 which dislodges the weight 28 from an operational portion as a sensor device, breaking the attraction between the permanent magnet and the metallic plate 28 *a* of the weight, such that the weight is added to swing plate 27. In this way the valve body 3 keeps the closed condition as shown in FIG. 6.

Contrary, when the end of the pushrod 4 is projected to out of the diaphragm cover 9 by operation of opening of the valve body 3, the end of the central lever 10 is parted from the weight which is returned to a normal portion, and by operation of resetting the device, the lever 17 maintains the valve open condition as shown in FIG. 4.

A reset button 24 which pushes and operates the valve spindle 12 through the lever 17 is provided on the housing 1 as shown in FIG. 2, but this button means 24 is only one of preferable embodiments, and other embodiments, i.e., string means which operates the lever 17 so as to push the valve spindle 12 could be used in place of the button means 24. An opening 29*a* is provided on a proper wall of the body 1 so as to check the indication plate 27*c* of the plate 27, and a test button 30 is provided through a cover 29 which is fixed to the housing 1.

With respect of operation and function of the automatic cutoff and tester apparatus of the present invention, after a gas pipe is connected to the inlet 1*a* and another gas pipe for terminal appliances direction is connected, gas is supplied. When the valve body 3 is keeping closed condition as shown in FIG. 3, gas is not supplied to the outlet passage 10 and the terminal appliances.

For check of the condition whether valves of the terminal appliances are closed or not at the time gas is firstly supplied after cutoff of the gas supply, by push of the reset button 24 in a short time each end of the levers 17 and 18 is upwardly moved in connection with each other and then the "U" shape swung plate 27 is slidably lifted up and the metallic plate 28*a* is approached to the permanent magnet 26, but they do not attract yet, since the valve body 3 is on the valve seat and one end of the control lever 10 is projected and pushes the weight to side direction which the weight is not positioned for attracting the permanent magnet.

By push of the reset button 24, the valve spindle 12 is slided and the reset valve 11 is accordingly opened, then gas from the fine hole of the bypass 1*d* flows to the outlet pass 1*c* and to the terminal appliances through the passages of the bypass 1*h*, the plenum chamber 5*a*, another bypass 1*i* and the sensor valve chamber 1*g* which is in opening condition of the sensor valve 13.

At this time when the valves of the terminal appliances are closed, the flowed gas stays in the outlet pass 1*c* and the plenum chamber 5*a* and the pressure of the gas is balanced in the both passes 1*a* and 1*c* and the plenum chamber 5*a*, and the gas applies pressure to the diaphragm 5, then the diaphragm 5 is reversed when the power of pressure overcomes the strength of the spring 20. Reversal of the diaphragm causes the valve body 3 to part from the valve seat 1*b*, and the passes 1*a* and 1*c* are normally connected, then gas flows.

When the valve is opened, the end of the valve pushrod 4 projects from the diaphragm cover and the projected end pushes on the end of the control lever 10. The lever 10 is in normal position and condition against the spring 21 and the weight 28 which is released the pressure of the lever 10 attracts to the permanent magnet 26.

At this time, even if the reset button 24 is released, the swung plate which is released by attraction 27 is slidably lifted up by the means of engagement of the side wall and the slit 17*a*, and the lever 18 which is supported by the flat spring 31 maintains its upward position and then the swung plate 27 is also keeping its upward position. This normal position of the swung plate 27 is checked through the opening 29*a* of the cover and confirms that gas flows and is normally supplied to the terminal appliances.

If desired, any indication can be fixed on the end of the swung plate 27 which is shown through the opening of the cover.

The extended end 18*a* of the lever 18 which keeps the released swung plate 27 in its vertical condition by means of the flat spring, and the extended end 18*a* supports the lever 17 at the end thereof as shown in FIG. 2, being pressed the valve pushrod 4 from pressure by the lever 17, and the fine groove 1*j* is continually closed. Therefore, the diaphragm 5 keeps the valve body 3 at opening condition by pressure of gas to the plenum chamber through the bypass 1*i* of the fine hole.

When it is in a condition of gas leak or of opening of the terminal appliances' valves at the time of the gas supply by operation of the reset button 24 which the gas is firstly supplied after cutoff of the gas supply. The test gas flows continuously to outlet pass 1c and does not stay therein, so gas pressure in the plenum chamber 5a does not rise. Therefore, the valve body 3 remains seated on the valve seat as long as the spring resilient power overpowers the pressure of the gas, and thus can prevent accidents which may be caused by the supply of a large volume of gas. Also, when the reset button 24 is released, the weight 28 falls down, since the metallic plate is not attracted to the permanent magnet by obstruction of the end of the control lever 10 which is not pushed by the valve pushrod 4. At this time, the indication plate 27c shows abnormal condition of the gas pipe or the terminal appliances through the opening 29a of the cover.

When earthquake or swing, which is over the predetermined amplitude, occurs during supply of the gas, the weight 28 falls apart from the permanent magnet 26 by its weight, and at the same time the swung plate 27 falls down, and also the end 27a of the plate 27 forces down the end of the lever 18 and the projected end 18a is moved into the slit 17a of the lever 17.

Therefore, since the end of the lever 17 falls down under the influence of the flat spring 19, the lever 17 pushes the valve spindle 14, then the sensor valve 13 which is fixed at the end of the spindle 14 is moved and closed the bypass 1e and contrary, the fine groove 1j is opened. The gas in the plenum chamber 5a flows out through the groove 1j to the atmosphere, then the pressure of the gas in the plenum chamber is rapidly released. Then, the diaphragm 5 is reversed by spring power of the spring 20 which overcomes the pressure of the gas, so the valve pushrod 4 arises and valve body 3 seals to the valve seat 16. By this way, the gas supply is automatically and rapidly cutoff.

When the gas is supplied after earthquake, test gas is supplied through the bypasses 1a and 1c by operation of the reset button or the same operative means, then safety is checked and confirmed, so, any accident by careless gas supply can be prevented.

As described above, the present invention is used as a tester of gas leak, and is used as an automatic cutoff apparatus of gas supply when earthquake or any other disaster with swing occurs, so that during only good condition of the gas pipe and the terminal appliances, will gas be supplied through the apparatus of the present invention. Accordingly, large volume gas leak from damaged parts by earthquake or disaster is prevented, reducing the possibility of explosion of the large volume gas leaked and preserving the precious gas resources.

The invention may be embodied in other specific forms without departing from its spirit or essential characteristics. The described embodiment is to be considered in all respect only as illustrative and the scope of the invention is, therefore, indicated by the appendent claims rather than by the foregoing description. All modifications which come within the meaning and range of equivalency of the claims are to be considered within the scope of the present invention. Consequently, it is recognized many variations may be made without departing from the scope or spirit of the present invention.

What is claimed is:

1. Apparatus comprising:

a gas inlet for connection to a gas supply pipe;

a gas outlet for connection to a gas delivery pipe;

a first valve connected between the gas inlet and the gas outlet;

a chamber containing a diaphragm coupled to the first valve for controlling the position thereof and means biasing the diaphragm to a position in which the first valve is closed;

means defining a first passage including a normally closed second valve provided between the gas inlet side of the first valve and the chamber for supplying gas, said second valve, when open, for supplying gas to the chamber for overcoming the bias of the means biasing the diaphragm to cause the diaphragm to move to a position in which the first valve is open;

means defining a second passage including a third valve provided between the chamber and the gas outlet side of the first valve, the third valve having a normal position providing a normally open path between the chamber and the gas outlet side of the first valve and a normally closed path between the chamber and a point of ambient pressure;

sensing means including a magnet and a movable weight which is attractable to the magnet;

means for preventing the weight from being attracted to the magnet when the first valve is closed; and resetting means, operable to open the second valve, for insuring said third valve is in its normal position, and for moving the weight into attraction by the magnet when the control valve is open;

the sensing means being responsive to an externally supplied force to cause the weight to fall from the magnet and consequently to control the third valve to move from its normal position to close said normally open path and to open said normally closed path, thereby to allow the means biasing the diaphragm to move the diaphragm to the position in which the first valve is closed.

2. Apparatus as claimed in claim 1, wherein each of the second and third valves includes a valve spindle and a spring biasing the spindle to a position corresponding to the normal position of the valve.

3. Apparatus as claimed in claim 2, wherein the resetting means comprises a first lever pivotable about a first axis between the spindles of the second and third valves, a second lever pivotable about a second axis parallel to the first axis, means for moving and responsive to movement of the weight relative to the magnet, means biasing the first lever, and manually operable means, the first lever including a first end arranged to engage the valve spindle of the third valve and being biased by the means biasing the first lever in a direction to move the third valve from its normal position, the second lever having ends which engage the first lever and the means for moving and responsive to movement of the weight and being pivotable between a first position to which the weight is attracted to the magnet, and in which the second lever prevents movement of the first lever to move the third valve from its normal position, and a second position in which the weight is not attracted to the magnet, and in which the second lever permits movement of the first lever to move the third valve from its normal position, the first lever including a second end arranged to engage the valve spindle of the second valve, the manually operable means being operable to move the first lever against the bias of the means biasing the first lever to open the second valve and to cause or allow the third valve to adopt or remain in its normal position, and the second lever being responsive to movement of the weight when the weight falls from the magnet to move from its first to its second position and being responsive to movement of the first lever upon operation of the manually operable means to move from its second position to its first position and simultaneously to move the means for moving and responsive to movement of the weight to move the weight to a position in which it can be attracted to the magnet.

4. Apparatus as claimed in claim 3, wherein the manually operable means comprises a manually depressable button.

5. Apparatus as claimed in claim 3, wherein the manually operable means comprises string means operable to move the first lever.

6. Apparatus as claimed in claim 3, wherein the means for moving and responsive to movement of the weight comprises a plate slidable vertically relative to the magnet, the plate having an upper part wich engages an end of the second lever and having a lower part including a slot, the weight including a constricted part which is engaged in the slot whereby vertical movements of the plate and the weight are correlated with one another.

7. Apparatus as claimed in claim 6, wherein the plate includes indicating means for providing an indication of the position thereof.

8. Apparatus as claimed in claim 1, wherein the first valve comprises a valve body mounted on a pushrod coupled to the diaphragm, which valve body is movable into and out of engagement with a valve seat respectively to connect the gas outlet to and isolate the gas outlet from the gas inlet, and wherein the means biasing the diaphragm comprises a spring biasing the diaphragm to move the pushrod to cause the valve body to engage the valve seat and the diaphragm is responsive to gas pressure within the chamber to overcome the bias of the spring to move the pushrod to cause the valve body to disengage the valve seat.

9. Apparatus as claimed in claim 8, wherein the means for preventing the weight from being attracted to the magnet when the first valve is closed comprises a lever having a first end biased to engage and move the weight to overcome attraction between the magnet and the weight, and having a second end engageable by the pushrod of the first valve to disengage the first end of the lever from the weight when the first valve is open.

10. Apparatus as claimed in claim 1, including manually operable means for acting on the weight to overcome the effect of the means for preventing the weight from being attracted to the magnet when the first valve is closed.

* * * * *